US005396820A

United States Patent [19]

Baker

[11] Patent Number: 5,396,820

[45] Date of Patent: Mar. 14, 1995

[54] OPEN END WRENCH WITH REMOVABLE HANDLE

[76] Inventor: David R. Baker, 7254 Laurie Dr., Fort Worth, Tex. 76112

[21] Appl. No.: 5,010

[22] Filed: Jan. 15, 1993

[51] Int. Cl.[6] ..... B25G 1/04

[52] U.S. Cl. ..... 81/177.2; 81/177.85; 81/177.8; 81/119

[58] Field of Search ..... 81/177.1, 177.8, 177.2, 81/177.7, 177.75, 177.85, 489

[56] References Cited

U.S. PATENT DOCUMENTS

| | | | |
|---|---|---|---|
| 1,753,441 | 4/1930 | Morehouse | 81/177.2 X |
| 1,822,428 | 9/1931 | Zilliox | 81/177.8 |
| 3,175,436 | 3/1965 | Coleman | 81/177.1 |
| 3,882,753 | 5/1975 | Svensen | 81/177.7 |
| 4,376,397 | 3/1983 | Newby et al. | 81/177.2 |
| 5,099,724 | 3/1992 | Reddy, Jr. | 81/177.2 X |

FOREIGN PATENT DOCUMENTS

| | | | |
|---|---|---|---|
| 434025 | 8/1935 | United Kingdom | 81/177.8 |
| 2050899 | 1/1981 | United Kingdom | 81/177.7 |

*Primary Examiner*—D. S. Meislin

*Attorney, Agent, or Firm*—James E. Bradley; Grady K. Bergen

[57] ABSTRACT

An extensible wrench handle that can be used with a removable wrench head. The wrench handle has a cross beam shaped primary handle over which an extension may be slid to various positions for increasing or decreasing torque. The wrench handle is also provided with a flexible head that is pivotal about a forward end of the primary handle. The flex head has a substantially square drive post which protrudes from a flat surface of the flex head, the edges of the drive post being convex curved surfaces. The wrench head is an open end wrench that has upper and lower jaws that are joined by a web. A neck is joined to the web and has a drive hole which extends through the neck. The drive hole is defined by sidewalls which are convex arcuate surfaces.

10 Claims, 4 Drawing Sheets

OPEN END WRENCH WITH REMOVABLE HANDLE

BACKGROUND OF THE INVENTION

1 Field of the Invention

This invention relates in general to an open end wrench, and in particular to an open end wrench head, usually called a crowfoot head and/or flare nut head, which is provided with a removable handle that can be extended for increased torque.

2. Description of the Prior Art

In a conventional open end wrench head with a removable handle, the wrench head is usually provided with a drive hole into which a drive post is inserted for coupling the handle to the wrench head. The open end wrench head is usually provided with rigid jaws joined to a shank or web. The jaws have parallel faces that are used to engage a nut or bolt having straight parallel sides.

In use, torque is applied to the handle and the force is transmitted through the drive post to the sides of the drive hole located in the wrench head. The shape of the drive post corresponds closely to the shape of the drive hole in the wrench head, which is usually square or polygonal, so that rotation of the drive post within the drive hole is very limited. During torque, corners of the drive post will contact the sides of the drive hole. Because only the corners of the drive post contact the drive hole, the corners will tend to wear off. The sides of the drive hole, which are flat surfaces, will also tend to round out.

Many removable wrench handles are also provided with extensions. These extensions allow the user to create greater torque by increasing the distance over which force can be applied. These usually consist of a cylindrical shaped primary handle over which a hollow extension can be slid along the length of the primary handle.

Because most open end wrenches employ jaws with parallel faces, the user is generally required to remove the wrench from the nut after each stroke and reposition it on the nut. However, there are several patents for open end ratcheting type wrenches. One open end wrench head that provides ratcheting action is shown in U.S. Pat. No. 4,889,020. These open end ratchet type wrenches allow the wrench to be slid around the nut in one direction while locking onto the nut in various drive positions when applying torque in an opposite direction.

SUMMARY OF THE INVENTION

This invention consists of an open end wrench head which couples to a removable handle that is extendable. Both the wrench head and the extendable handle may be used in conjunction with conventional heads, handles and drive extensions.

The open end wrench head has upper and lower jaws joined to a web. A substantially square neck having a forward end is joined to the web and has a polygonal hole which extends through the neck. The polygonal hole has convex curved sidewalls for receiving a drive post of the handle so that there is more surface area contact between the drive post and the drive hole.

The removable handle has a cross beam shaped primary handle to which a flex head is pivotally mounted so that the flex head is pivotal about a transverse axis perpendicular to the primary handle. The drive post extends perpendicularly from a flat surface of the flex head for inserting into the drive hole of the neck of the wrench head. The edges of the drive post are preferably convex curved surfaces but may be flat. Stops limit the rotation of the flex head around the transverse axis. A heel surface is also provided on the flexible head, adjacent to the drive post, the heel surface is a convex arcuate surface. When used with the wrench head of this invention, the heel surface contacts a side of the neck along with a facing edge of the drive post to provide the primary driving force. The drive handle may also be used with standard extensions.

A handle extension provides increased leverage when using the primary handle. The extension is hollow and has an interior which corresponds to the cross beam shape of the primary handle. The extension is mounted over the primary handle and can be moved coaxially to various positions along the length of the primary handle. The extension is provided with a pawl having a tongue. The tongue is mounted to the extension by a retaining screw and has a locking member located on a forward portion of the tongue. The locking member protrudes through an aperture in the extension and engages notches which are located in an upper shoulder of the cross beam shaped primary handle. The pawl is resilient enough to be moved to an open position when an appropriate force is applied, but will spring back to a closed position when the force is removed.

Another feature of this invention includes a ratchet type open end wrench head for use with hexagonal nuts. The ratchet type wrench head has upper and lower jaws. The upper jaw has an upper primary drive face and an upper secondary drive face which are both convex arcuate surfaces. The lower jaw has a lower primary drive face and a lower secondary drive face which are both convex arcuate surfaces. A rear stop face, which is a convex arcuate surface, is located at the junction of the upper and lower jaws. There are also upper and lower stop faces located adjacent the drive faces. The upper stop face being a convex arcuate surface. The distance between the upper stop face and the lower stop face being greater than a point-to-point diameter of the nut, enabling the wrench to be rotated between drive positions without removing the wrench from the nut.

DETAILED DESCRIPTION OF THE INVENTION

Figure 1:
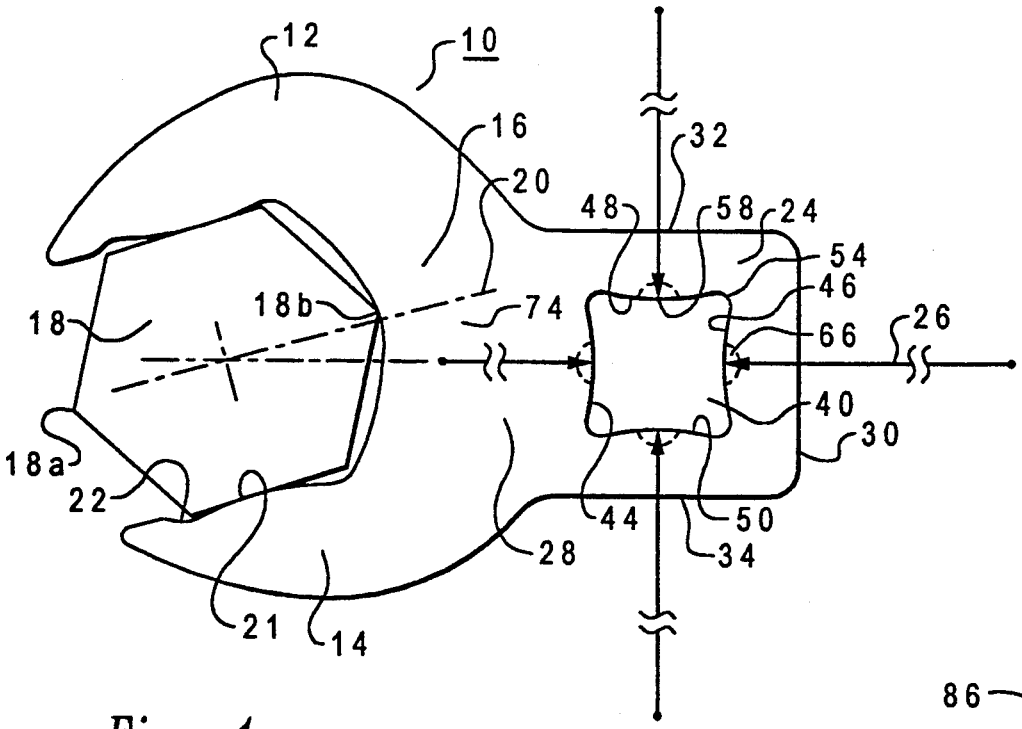
FIG. 1 is a side view of an open end wrench head constructed in accordance with this invention.

Referring to FIG. 1, the wrench head 10 has an upper jaw 12 and a lower jaw 14. The upper jaw 12 and lower jaw 14 are connected by a web 16. Upper and lower jaws 12, 14 engage the sides of a hexagonal nut or bolt 18. A center line 20 of the web 16 extends through the points 18*a* and 18*b* of the nut 18. Upper and lower jaws 12, 14 have curved drive surfaces 21 to avoid contact with the corners of nut 18. A notch 22, located on both the upper and lower jaws 12, 14, is provided to prevent the nut 18 from being removed from the jaws 12, 14 of the wrench head 10 during torque.

The wrench head 10 has a square neck 24. The neck 24 has a longitudinal axis 26 which extends from a forward side 28 to a rearward side 30 of the neck 24. The neck 24 is integrally formed with and joined to the web 16 at the forward side 28. Upper and lower sides 32, 34 extend from and join the forward and rearward sides 28, 30. The upper and lower sides 32, 34 are substantially parallel with the longitudinal axis 26. The rearward, upper and lower sides 30, 32, 34 form an outer surface of the neck 24.

A polygonal drive hole 40 extends through the neck 24. The polygonal hole 40 is preferably a square having opposite facing forward and rearward sidewalls 44, 46. The forward and rearward sidewalls 44, 46 are joined by opposite facing upper and lower sidewalls 48, 50 to form corners 54 at each junction where the sidewalls 44, 46, 48, 50 intersect. A centerpoint 58 is located on each sidewall 44, 46, 48, 50. Each sidewall 44, 46, 48, 50 is a convex, arcuate surface and curves from the centerpoint 58 to the corners 54. The distance between the forward and rearward sidewalls 44, 46 is smallest between the centerpoints 58 and greatest at the corners 54. The distance between the upper and lower sidewalls 48 and 50 is smallest between the center points 58 and greatest at the corners 54. The arcuate surface preferably is a convex curve having a variable radius with the radius R1 being the greatest at the centerpoint 58 and decreasing toward the corners 54. The sidewalls 44, 46, 48, 50 are provided with an undercut space, depression or cavity 66 which is located near the centerpoint 58 of each sidewall 44, 46, 48, 50.

The center line 20 of the web 16, as shown in FIG. 1, is at an acute angle 74 with the longitudinal axis 26 of the neck 24. The angle 74 is approximately 15 degrees.

The drive hole 40 is centered in the neck 24 so that the rearward sidewall 46 corresponds to and is substantially parallel with the rearward side 30 of the neck 24. The upper and lower sidewalls 48, 50 also correspond to and are substantially parallel with the upper and lower sides 32, 34 respectively. The thickness between each corresponding sidewall and side is substantially the same for each.

Figure 2:
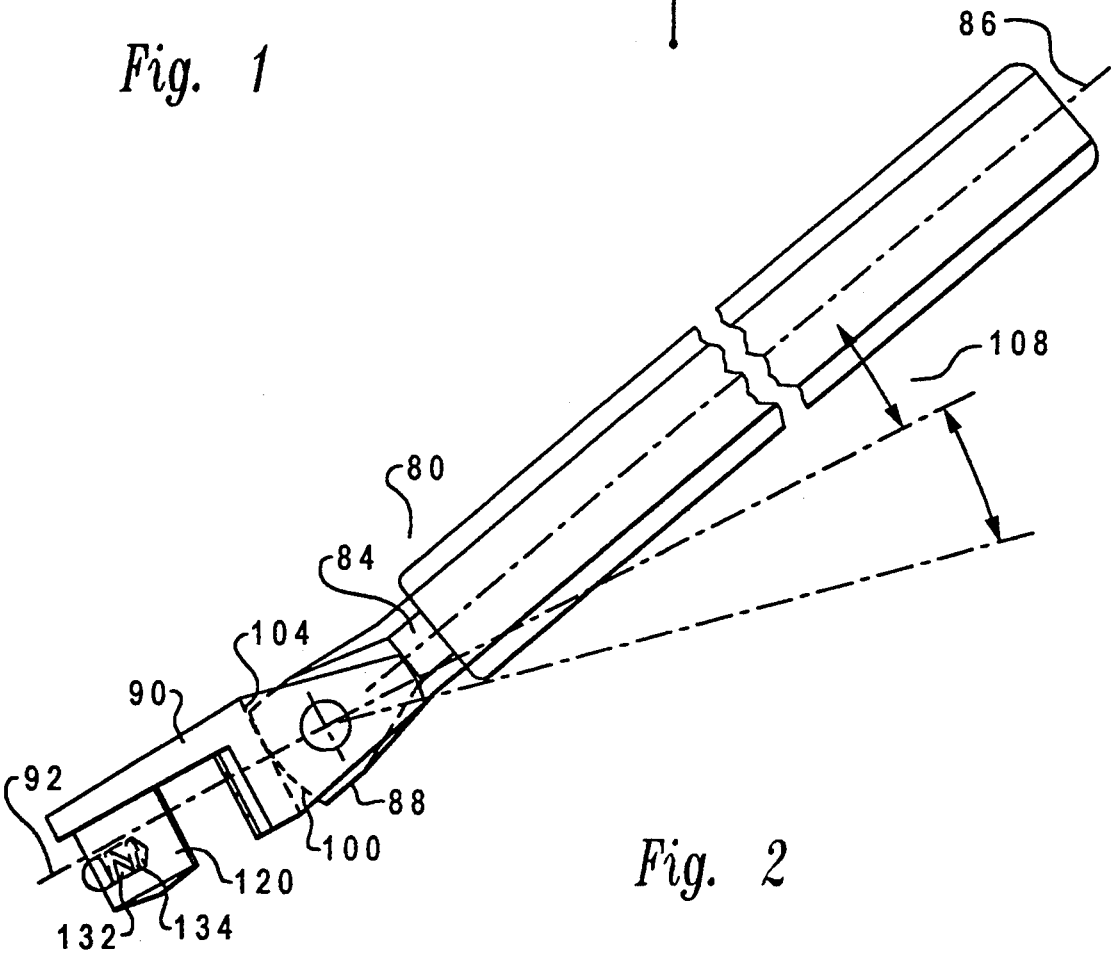
FIG. 2 is a side view of a removable wrench handle constructed in accordance with this invention.
Figure 3:
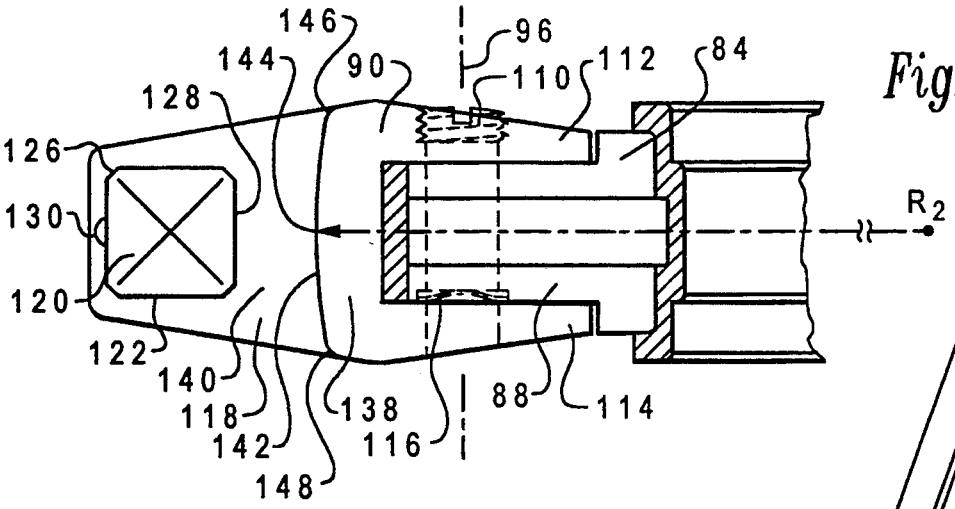
FIG. 3 is another side view of the removable wrench handle of FIG. 2 rotated ninety degrees from the view of FIG. 2, enlarged and showing the flex head.

FIG. 2 shows a removable wrench handle 80. The wrench handle 80 has a primary handle 84 which has a longitudinal axis 86 extending from a forward end 88 to a rearward end (not shown). A flex head 90 is located on the forward end 88 of the primary handle 84. The flex head 90 is hot forged, orbital forged or machined from a single piece of high carbon alloy tool steel. The flex head 90 rotates about a transverse axis 96, as shown in FIG. 3, which is perpendicular to the longitudinal axis 86 of the primary handle 84. Two stops 100 are located on the forward end 88 of the primary handle 84 which limit the rotation of the flex head 90 about the axis 96 in both a clockwise and counterclockwise direction. Each stop 100 is a flat surface which is sloped at an angle $12\frac{1}{2}$ degrees from a plane perpendicular to the longitudinal axis 86. The stops 100 allow the primary handle 84 to be rotated about the transverse axis 96 so that the longitudinal axis 86 of the primary handle 84 can be rotated from zero to $12\frac{1}{2}$ degrees in either a clockwise or counterclockwise direction relative to the longitudinal axis 92 of the flex head 90.

When the primary handle 84 is rotated $12\frac{1}{2}$ degrees from the axis 92 of the flex head 90, the stop 100 contacts a rear portion 104 of the flex head 90 preventing the primary handle 84 from being further rotated. The rear portion 104 of the flex head 90 is a flat surface located in a plane which is perpendicular to the longitudinal axis 92 of the flex head 90. FIG. 2 shows the handle 84 rotated at an angle 108 from longitudinal axis 92 of the flex head which is $12\frac{1}{2}$ degrees.

The flexible head 90 is attached to the primary handle 84 by means of a threaded pin 110 (FIG. 3). The pin 110 extends through arms 112, 114 and the forward portion 88 of the primary handle 84 along axis 96. The threaded pin 110 is removable and preferably is mounted with a drag washer 116. The drag washer 116 offers slight resistance during rotation of the flex head 90 around the transverse axis 96. This stabilizes the flex head 90 so that it is does not freely swing about the transverse axis 96.

Flex head 90 is provided with a flat surface 118 which is in a plane parallel to the axis 96. A drive post 120 extends perpendicularly from the surface 118, perpendicular to axis 96 and also handle axis 86 (FIG. 2). The drive post 120 is preferably square shaped having edges 122, but may be any polygonal shape which corresponds to the drive hole of a wrench head such as wrench head 10 shown in FIG. 1. The outer extent of each edge 122 intersects an adjacent edge 122 to form corners 126. These corners may be beveled, as in FIG. 3, for easy insertion of the drive post 120 into the drive hole 40 of the wrench head 10. Each edge 122 is a convex curve with a radius which decreases from the center to the outer extent or corners 126 of each edge 122. A facing edge 128 faces toward the rear of the flex head 90.

A retaining ball 130 protrudes from one of the edges 122 for fitting into the undercut space 66 of the wrench head 10. As can be seen in FIG. 2, the ball 130 is located in cavity 132. A spring 134 provides a force which causes the ball 130 to protrude from the cavity 132, but allows the ball 130 to slip back into cavity 132 during insertion of the drive post 120 into the drive hole 40. When the drive post 120 is fully inserted in drive hole 40, the ball 130 will extend into one of the cavities 66 to lock the wrench head 10 on the drive post 120.

A heel member 138 protrudes from the surface 118 of the flex head 90 near the drive post 120. A clearance 140 exists between the heel member 138 and the drive post 120. The heel member 138 has a heel surface 142 which faces the drive post 120. The heel surface 142 is a convex curved surface which curves from a center 144 to edges 146, 148. The heel surface 142 is preferably a compound curve having a variable radius R2 which decreases from the center 144 of the heel face 142 to the edges 146, 148. The facing edge 128 of the drive post 120 faces the heel surface 142.

Figure 4:
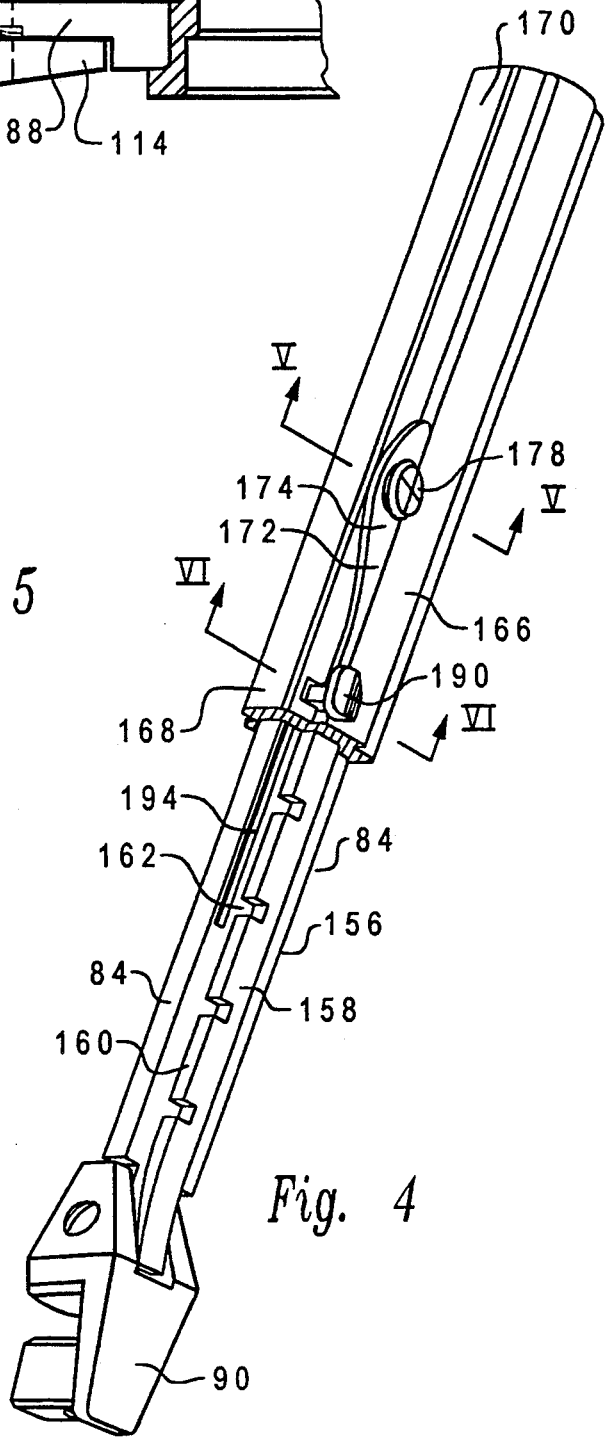
FIG. 4 is a perspective view of the removable wrench handle of FIG. 2, showing the extension pulled toward the rear of the primary handle.

Referring to FIG. 4, the primary handle 84 has a cross-beam shape having a generally rectangular main portion 156. A generally rectangular side band 158 is located on one side of the main portion 156. The side band 158 has an upper facing shoulder 160 with several notches 162. A second generally rectangular side band 164 (FIG. 5) is located on an opposite flat side of the main portion 156.

An extension 166, having a longitudinal axis which extends from a forward end 168 to a rearward end 170, mounts over the primary handle 84. The extension 166 is hollow and has an interior shape which corresponds to the cross-beam shape of the primary handle 84. While mounted, the extension 166 can be slid to a variety of positions along the length of the primary handle 84. The extension 166 allows a user to increase or decrease leverage by extending or contracting the extension 166 over the primary handle 84.

Figure 5:
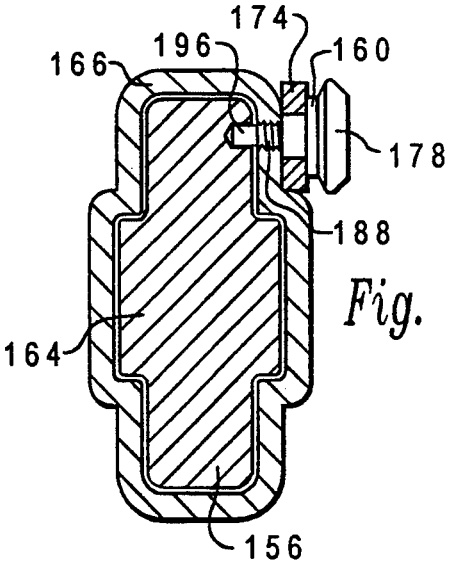
FIG. 5 is a cross sectional view of the wrench handle of FIG. 4, taken along the lines V—V.
Figure 6:
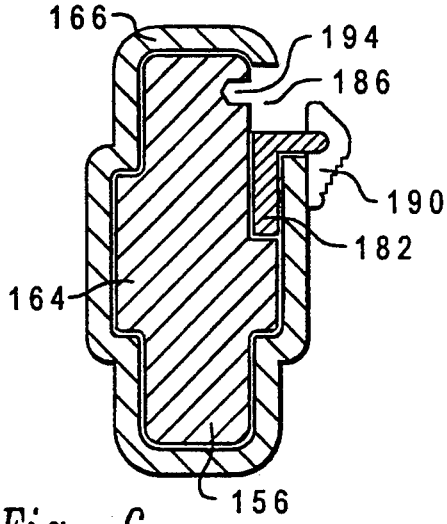
FIG. 6 is a cross sectional view of the wrench handle of FIG. 4, taken along the lines VI—VI.

The extension 166 is provided with a pawl 172. Pawl 172 consists of a tongue 174 with a forward end and a rearward end. The rearward end of tongue 174 is mounted to the extension 166 by a retaining screw 178. Retaining screw 178 securely holds the rearward end of the tongue 174 in place. Referring to FIG. 5, a positive lock washer 180 is used to keep the retaining screw 178 from vibrating loose or otherwise becoming unscrewed. A locking member 182 (FIG. 6) is located on the forward end of the tongue 174. The locking member 182 protrudes through an aperture 186 in the extension 166 for engaging the notches 162 in the upward facing shoulder 160 of the primary handle 84. The retaining screw 178 has threads 188 which allow the screw 178 to be loosened or removed. The tongue 174 is made of a resilient material, such as spring steel, which will flex when force is applied so that the pawl 172 will move about an axis located at the rearward end of the tongue 174. The pawl 172 moves from a lower closed position to an upper open position. When the pawl 172 is in the closed position, the tip of the locking member 182 will engage one of the notches 162 to prevent the extension 166 from sliding along the primary handle 84. A thumb press 190 is located at the forward end of the tongue 174 to allow the user to move the pawl 172 to the open and closed positions.

An elongated retaining groove or slot 194 is located in the surface of the primary handle 84 (FIGS. 4, 5, 6) The tip 196 of the retaining screw 178 protrudes into the slot 194 from the interior of the extension 166, however, a separate screw (not shown) could also be used. When the extension 166 is mounted over the primary handle 84 and the retaining screw 178 is in the fully seated position, the tip 196 slides within the slot 194 as the extension 166 is slid along the length of the primary handle 84. A retaining edge (not shown) is located at the end of the slot 194 towards the rearward end of the primary handle 84. When the extension 166 is slid toward the rear of the primary handle 84, the tip 196 will come into contact with a retaining edge (not shown) located at the end of the slot 194. This prevents the extension 166 from sliding off the primary handle 84. The retaining screw 178, however, should not come into contact with the retaining edge when the locking member 182 is engaged with the notches 162. This keeps the retaining screw 178 from bearing any load when the extension 166 is locked in place.

By rotating the retaining screw 178 counterclockwise a few turns, the screw 178 may be raised from the fully seated position so that the tip 196 does not contact the retaining edge (not shown). This allows the extension 166 to be slipped off the primary handle 84 when the pawl 172 is not engaged with the notches 162.

The extension 166 and primary handle 84 may be marked with indicia (not shown) to indicate the appropriate handle length and notch 162 to be engaged for use with a given nut size.

Figure 7:
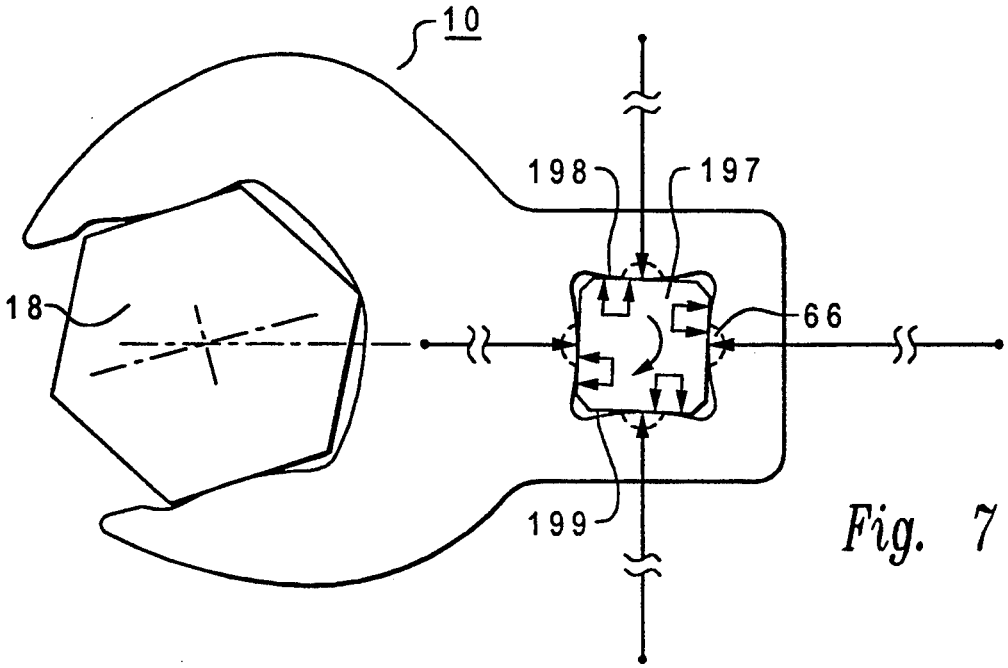
FIG. 7 is a side view of the wrench of FIG. 1, shown engaged with a drive post of conventional design having flat edges.

FIG. 7 shows the wrench head 10 of FIG. 1 engaged with a conventional drive post 197. The drive post 197 in FIG. 7 extends through the neck 24. The undercut spaces 66 receive a retaining ball (not shown) similar to retaining ball 130 located on the drive post 120.

When used with the conventional drive post 197, the drive post 197 contacts the sidewalls 44, 46, 48, 50 during torque at areas 198 of each edge 199. Torque is applied about an axis extending through the center of the drive post 197. FIG. 7 shows the drive post 197 engaging the drive hole 40 during clockwise rotation as viewed from the side. The drive post 197 can be inserted into the drive hole from either side of the neck 24.

Figure 8:
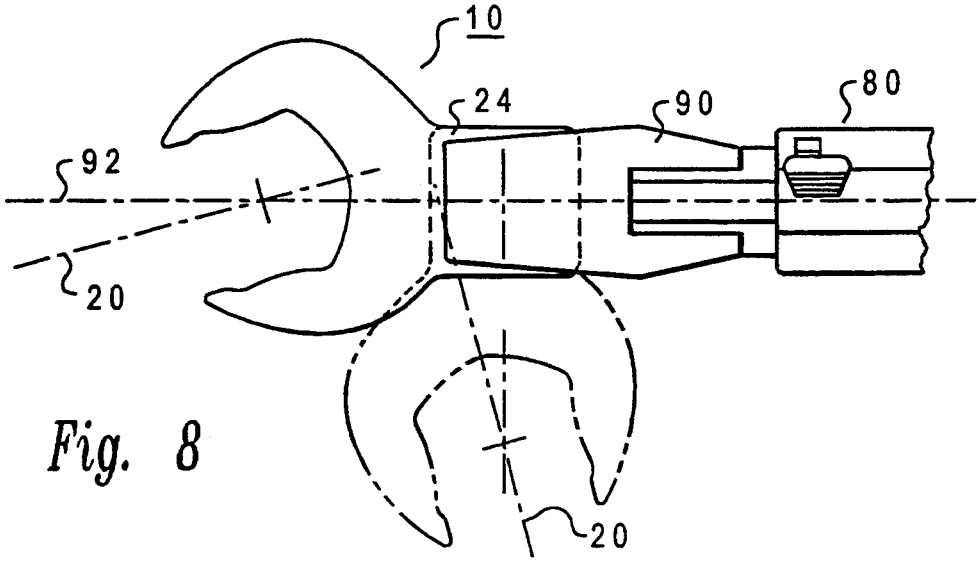
FIG. 8 is another side view of the open end wrench head and removable handle of FIGS. 1 and 2, shown engaged at right angles.

FIG. 8 shows the flex head 90 with the drive post 120 inserted through neck 24. The flex head 90 engages the wrench head 10 of the invention so that the wrench handle 80 extends perpendicular from either of the sides of the neck 30, 32 and 34. With the wrench handle 80 extending from the rearward side 30, as shown by the solid lines in FIG. 8, the center line 20 is at an angle of approximately 15 degrees to the longitudinal axis 92 of the flex head 90. Alternatively, the handle 80 may extend from the upper side 32 or lower side 34. As shown by the broken lines in FIG. 8, the handle 80 extends from the lower side 34 so that the center line 20 is 75 degrees relative to the longitudinal axis 92 of the flex head 90. The wrench head 10 can also be flipped over to provide different angles through which the wrench handle 80 can be rotated.

Figure 9:
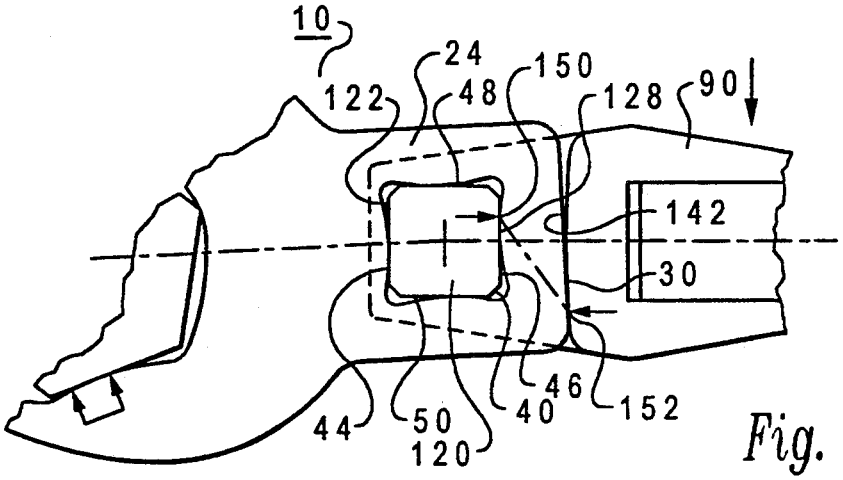
FIG. 9 is another side view of the open end wrench head and the flex head of the removable handle of FIG. 1 and 2, showing the drive post engaged with the neck of the wrench head.

FIG. 9 shows the flex head 90 of the invention engaged with the wrench head 10 and extending from the rearward side 30 of the neck 24. The drive post 120 of the flex head 90 engages the sidewalls 44, 46, 48, 50 on the edges 122 of the drive post 120, instead of the corners 126. However, the primary drive force is applied to the wrench head 10 by the facing edge 128 and the heel surface 142. Here, the handle 80 is rotated in a clockwise direction. Torque is applied about an axis running through the rearward portion of the neck 24 instead of an axis running through the center of the drive post 120. The facing edge 128 contacts rearward sidewall 46 of the drive hole 40 at area 150. The rearward side 30 of the neck 24 contacting the heel surface 142 at area 152. Torque is thereby transmitted from the flex head 90 to the wrench head 10 at areas 150 and 152. Drive post edges 122 contacting the forward sidewall 44, upper sidewall 48 and lower sidewall 50 merely provide a stabilizing force since most of the force is applied between the facing edge 128 and the heel surface 142. This prevents rounding out of the drive hole 40 because there is no rotational force by the drive post 120 in the drive hole 40. Because the thickness between the sidewalls 46, 48, 50 of the drive hole 40 and the corresponding sides 30, 32, 34 of neck 24 is the same, the heel surface 142 and facing edge 128 will also contact the upper and lower sides 32, 34 and sidewalls 48, 50 when the flex head 90 extends from either of sides 32, 34.

The user can increase or decrease torque by adjusting the length of the handle 80. The length of the handle 80 is adjusted by repositioning the extension 166 over the primary handle 84. To reposition the extension 166 along the primary handle 84, the pawl 172 must be disengaged from the notch 162. To disengage the pawl 172 from the notch 162, the user pushes the thumb press 190 so that the pawl 172 bends or pivots to an open position. This bending or pivoting motion of the pawl 172 is in a plane generally parallel to the side of the main portion 156. When the pawl 172 is in the open position, the extension 166 may be slid along the length of the primary handle 84. When the thumb press 190 is released, the pawl 172 will move toward the closed position. The locking member 182 will ride along the upward facing shoulder 160 of the side band 158 allowing the extension 166 to be slid along the primary handle 84 until the locking member 182 is aligned with one of the notches 162. Because of the resilience of the tongue 174, the locking member 182 will be forced into the notch 162 so that the extension 166 is locked in place.

The extension 166 may be slid off the primary handle 84 by rotating the retaining screw 178 counterclockwise a few turns. This raises the screw 178 from the fully seated position so that the tip 196 will clear the retaining edge (not shown) when the extension 166 is slid to the rear of the primary handle 84. The extension 166 may then to be slipped off the primary handle 84 for cleaning or maintenance.

Figure 10:
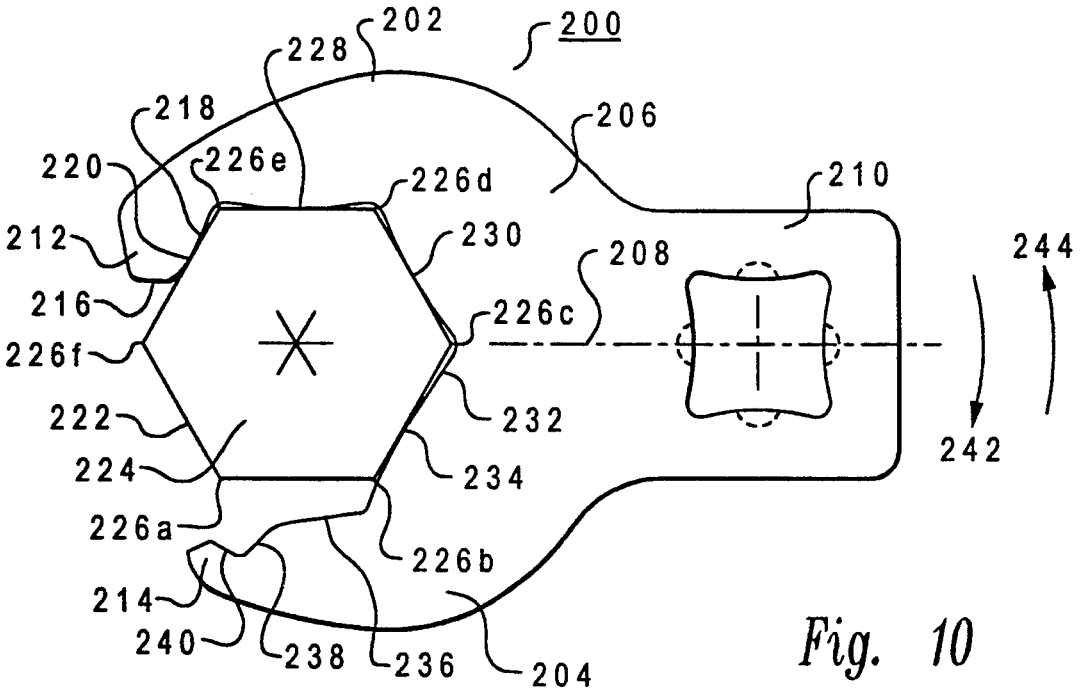
FIG. 10 is a side view of an alternate embodiment of a wrench head constructed in accordance with this invention, engaged with a nut in the primary drive position.

FIG. 10 shows an alternate embodiment of a wrench head 200 with upper and lower jaws 202 and 204. Upper and lower jaws 202, 204 are joined to a web 206. A center line 208 divides the upper and lower jaws 202, 204, both of which are rigidly formed together with the web 206. A neck 210, constructed in the same manner as neck 24 of wrench head 10 in FIG. 1, is connected to the web 206.

The upper jaw 202 has an upper free end 212 located on the forward portion of the upper jaw 202. A lower free end 214 is located on the forward portion of the lower jaw 204. Upper and lower free ends 212, 214 are spaced apart from each other on either side of the center line 208.

A nose drive 216 is located on the upper free end 212. The nose drive 216 protrudes substantially toward the lower free end 214. The nose drive 216 contains an upper primary drive face 218 and an upper secondary drive face 220. The upper primary drive face 218 extends rearward from the upper free end 212 and is convex arcuate surface. The upper secondary drive face 220 is located forward and adjacent to the upper primary drive face 218 on the upper free end 212. The upper secondary drive face 220 is a convex arcuate surface.

The upper primary drive face 218 and the upper secondary drive face 220 are adapted to engage a side 222 of a hexagonal nut 224. The nut 224 has six corners 226 a,b,c,d,e,f. Each side 222 intersects an adjacent side 222 at an angle of 120 degrees. An upper stop face 228 extends rearward from the upper primary drive face 218. The upper stop face 228 intersects the upper primary drive face 218 at an obtuse angle. The length of the upper stop face 228 is about the same length as one of the sides 222 of nut 224. The upper stop face 228 is a convex arcuate surface. A back stop face 230 extends from the upper stop face 228 at substantially a 120 degree angle. The back stop face 230 extends toward the lower jaw 204 for a distance substantially equal to the length of one side 222 of the nut 224. The back stop face 230 is a convex arcuate surface.

A slide face 232 extends forward from the back stop face 230. The slide face 232 is a flat surface and intersects the back stop face 230. The angle of intersection is approximately 120 degrees. The slide face 232 extends forward about half the length of a side 222 of nut 224. The forward edge of the slide face 232 intersects a lower primary drive face 234. The lower primary drive face 234 extends forward and is a convex arcuate surface. The lower primary drive face 234 and upper primary drive face 218 engage opposite sides 222 of the nut 224 in the primary drive position.

A lower stop face 236 extends from the forward edge of the lower primary drive face 234. The lower stop face 236 is flat and is substantially parallel to the upper stop face 228. The distance between the lower stop face 236 and the upper stop face 228 is slightly more than the point-to-point distance between the two opposite corners 226 of nut 224. In the primary drive position, shown by the nut 224 in FIG. 10 outlined in solid lines, a substantial clearance will exist between the lower stop face 236 and the side 222 located between corners **226*a* and 226*b***.

A lower secondary drive face 238 extends forward from the lower stop face 236. The lower secondary drive face 238 is a convex arcuate surface. The distance between the lower secondary drive face 238 and the upper secondary drive face 220 is approximately the distance from opposite sides 222 of the nut 224.

The nose drive 216 acts as a barrier to keep the nut 224 in the primary drive position when the wrench head 200 is pulled in a generally rearward direction along the center line 208.

A retention face 240 is located on the lower free end 214 and joins the lower secondary drive face 238. The retention face 240 helps to retain the nut 224 in the secondary drive position shown by the nut 224 in FIG. 11 outlined by the dashed lines. The distance between the forward end of the retention face 240 and the surface of the upper secondary drive face 220 is smaller than the point-to-point distance of the nut 224 from opposite corners 226. This prevents the wrench head 200 from slipping off of the nut 224 when the wrench head is pulled in a generally rearward direction.

Figure 11:
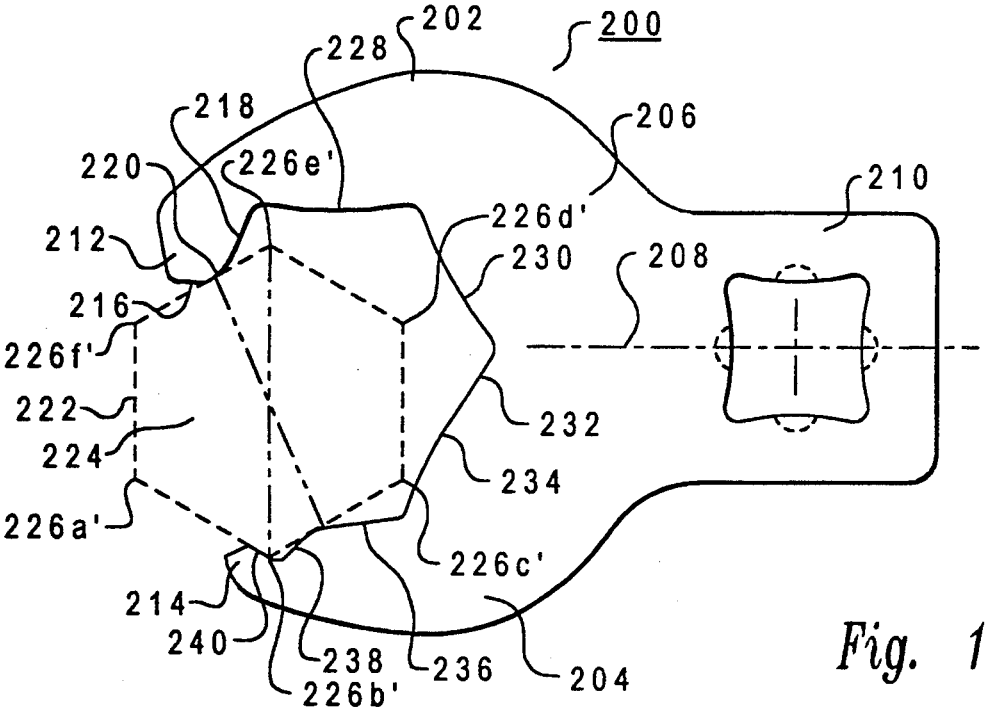
FIG. 11 is another side view of the wrench head of FIG. 10, shown engaged with a nut in the secondary drive position.

In operation of the embodiment of FIGS. 10 and 11, the wrench head 200 of FIG. 10 may be used with the wrench handle 80 of FIG. 2. The wrench head 200 is placed around the nut 224 by moving the wrench head forward relative to the nut 224 with the side 222 between points **226*a* and 226*d* sliding against the lower stop face 236 until the lower primary drive face 234 touches the side 222 between points 226*b* and 226*c*. The wrench head 200 is then pushed forward and lowered slightly until the side 222 of the nut 224, between points 226*c* and 226*d*, touches the back stop face 230. A flat portion of the side 222, between points 226*e* and 226*f*, will be in contact with the upper primary drive face 218. A flat portion of the side 222, between points 226*b* and 226*c*, will be in contact with a portion of the lower primary drive face 234. This is the primary drive position. The curved surface of the upper stop face 228 will be in contact with the side 222 of nut 224 between points 226***d* and 226*e*. The curved surface of the back stop face 230 will also be in contact with the side 222 of nut 224 between points 226*c* and 226*d*. If the wrench head 200 is moved rearward and upward slightly, the wrench head 200 will still be in the primary drive position but without contacting the upper or back stop faces 228, 230. The corners 226 of the nut 224 will not contact any portion of the wrench head 200 while in the primary drive position. When torque is applied in the direction of the arrow 242, force will act on the sides 222 of the nut 224 to cause the nut 224 to rotate.

At the completion of each stroke, the user rotates the wrench head 200 in reverse to a new stroke, as shown by the arrow 244. The user has an option of rotating a full 60 degrees, or more, relative to nut 224 for a new stroke in the primary drive position. If so, the user maintains a light forward pressure on the wrench head 200 during the reverse rotation, the wrench will automatically slide into the next primary drive position.

If space prevents a full 60 degree rotation, the user can rotate the wrench head 200 only approximately 30 degrees for an intermediate or secondary drive position, which is shown by the dashed lines outlining the nut 224 in FIG. 11. As the user begins to rotate counterclockwise as shown by arrow 244 in FIG. 10, the user should maintain a slight forward pressure on the wrench head 200. The upper stop face 228 will slide on point 226*e*. The back stop face will slide on point 226*d*. The slide face 232 will slide on point 226*c*. When the rotation is about 30 degrees, the user should move the wrench head 200 rearward relative to the nut 224. The portion of the side 222 of the nut 224 between points 226*a'* and 226*b'* in FIG. 11 will contact the retention face 240. Torque can then be applied in the clockwise direction. The upper secondary drive surface 220 will act on the side 222 of the nut 224 between points 226*e'* and 226*f'*. The lower secondary drive face 238 will act on the side 222 of nut 224 between points 226*b'* and 226*c'*. When in this position, the retention face 240 prevents the wrench head from being removed from the nut 224 when the wrench head 200 is moved in a generally rearward direction. The wrench head 200 can be removed from the nut 224 by slightly rotating the wrench head 200 counterclockwise so that the corner 226*b'* is forward of the retention face 240 and moving the wrench head 200 rearward.

If desired, a reverse torque can be applied while in the secondary drive position. This position is not shown, but it consists of rotating the wrench head 200 counterclockwise from the secondary drive position shown in FIG. 11. The corner 226*b'* will slide past the forward end of the retention face 240, and the upper secondary drive surface 220 will engage the side 222 between points 226*e'* and 226*f'* and near point 226*f'*. The lower stop face 226 will engage a portion of the side 222 between points 226*b'* and 226*c'*.

To move from the secondary drive position back to the primary drive position, the user pushes forward on wrench head 10 and rotates counterclockwise. The wrench head 10 will slide back into the primary drive position automatically.

There are several advantages to this invention. Because of the extended square neck, the wrench head of this invention may be used by itself during low torquing operations by using the neck as a short handle. The curved sidewalls of the drive hole prevent the corners of a conventional drive post from contacting the sidewalls and rounding out the hole or wearing down the corners of the drive post.

The removable wrench handle can be used with conventional wrench heads, as well as the improved wrench head of the invention. The cross-beam shape of the primary handle provides more surface area contact between the extension and the primary handle and is stronger than a circular primary handle and extension of equal cross-sectional area. The flex head allows the removable handle to be positioned for additional knuckle space.

The drive post of the flex head prevents rounding out of the drive hole and wearing of the corners of the drive post. Because the edges of the drive post are curved, the corners do not come in contact with the sidewalls of the drive hole and therefore cannot wear down or cut into the sidewalls. When the flex head is used with the wrench head of this invention, the heel surface of the flex head and the facing edge of the drive post transmit most of the torque to the neck of the wrench head. This is because the torque forces are being applied about an axis which extends through a portion of the neck and not about an axis extending through the center of the drive post. Thus, there are no rotational forces inside the drive hole. This prevents rounding out of the drive hole.

The arcuate surfaces of the ratchet type wrench head is an improvement over other open end ratchet type wrench heads using flat drive surfaces. The curved surfaces provide better contact to the sides of the nut and prevent any corner contact which could wear the corners of the nut. The nose drive and retaining face help to maintain contact with the nut and prevent the nut from slipping out of the drive positions.

While the invention has been shown in only one of its forms, it should be apparent to those skilled in the art that it is not so limited, but is susceptible to various changes without departing from the scope of the invention.

I claim:

1. An extensible wrench handle for use with a removable wrench head having a neck with a drive hole, comprising in combination:

a primary handle having a longitudinal axis which runs from a forward end to a rearward end, the primary handle having a generally rectangular main portion and a rectangular side band located on one side of the main portion, the side band having an upward facing shoulder;

a plurality of notches located in the upward facing shoulder;

a hollow extension having a longitudinal axis which runs along its length and having an interior which corresponds to the primary handle, the extension mounting over the primary handle so that the extension may be slid coaxially to various positions along the length of the primary handle, for increasing and decreasing leverage during torque;

an aperture in the extension adjacent the notches;

a pawl having a tongue with a forward end and a rearward end, the rearward end being mounted to the extension, the tongue being movable around an axis extending through the rearward end, allowing the pawl to be moved from an upper open position to a lower closed position, and having a locking member located on the forward end of the tongue that protrudes through said aperture in the extension for engaging the notches of the primary handle when the pawl is in the closed position, the pawl keeping the extension locked in place when the locking member is engaged with one of the notches.

2. The wrench handle of claim 1, wherein:

the rearward end of the pawl is mounted to the extension by a retaining screw.

3. An extensible wrench handle for use with a removable wrench head having a neck with a drive hole, comprising in combination:

a primary handle having a longitudinal axis which runs from a forward end to a rearward end, the primary handle having a generally rectangular main portion and an upward facing shoulder located on one side of the main portion;

a plurality of notches located in the upward facing shoulder;

a hollow extension having a longitudinal axis which runs along its length and having an interior which corresponds to the primary handle, the extension mounting over the primary handle so that the extension may be slid coaxially to various positions along the length of the primary handle, for increasing and decreasing leverage during torque;

an aperture in the extension adjacent the notches;

a pawl having a tongue with a forward end and a rearward end, the rearward end being mounted to the extension, the tongue being movable around an axis extending through the rearward end, allowing the pawl to be moved from an upper open position to a lower closed position, and having a locking member located on the forward end of the tongue that protrudes through the aperture in the extension for engaging the notches of the primary handle when the pawl is in the closed position, the pawl keeping the extension locked in place when the locking member is engaged with one of the notches, the rearward end of the pawl being mounted to the extension by a retaining screw; and wherein the primary handle has a retaining slot running along the length of the main portion of the primary handle from the forward end toward the rearward end, the slot having a retaining edge at the rearward end; and the retaining screw has a tip which protrudes from the interior of the extension and fits into the retaining slot, the tip sliding within the slot as the extension is slid along the length of the primary handle, the tip coming into contact with the retaining edge as the extension is slid to the rearward end, thus preventing the extension from slipping off the primary handle when the retaining screw is fully seated.

4. The wrench handle of claim 3, wherein:

the retaining screw can be unscrewed from the fully seated position so that it does not contact the retaining edge and the extension may be slipped off the primary handle.

5. The wrench handle of claim 1, further comprising:

means for urging the pawl to the closed position.

6. The wrench handle of claim 1, wherein:

the tongue is resilient for urging the pawl to the closed position.

7. An extensible wrench handle for use with a removable wrench head having a neck with a drive hole, comprising in combination:

a primary handle having a longitudinal axis which runs from a forward end to a rearward end, the primary handle having a generally rectangular main portion and an upward facing shoulder located on one side of the main portion;

a plurality of notches located in the upward facing shoulder;

a hollow extension having a longitudinal axis which runs along its length and having an interior which corresponds to the primary handle, the extension mounting over the primary handle so that the extension may be slid coaxially to various positions along the length of the primary handle, for increasing and decreasing leverage during torque;

an aperture in the extension adjacent the notches;

a pawl having a tongue with a forward end and a rearward end, the rearward end being mounted to the extension, the tongue being movable around an axis extending through the rearward end, allowing the pawl to be moved from an upper open position to a lower closed position, and having a locking member located on the forward end of the tongue that protrudes through the aperture in the extension for engaging the notches of the primary handle when the pawl is in the closed position, the pawl keeping the extension locked in place when the locking member is engaged with one of the notches; and wherein said one side of the main portion is flat and wherein the movement of the tongue of the pawl around the axis extending through the rearward end is in a plane parallel with said one side of the main portion.

8. An extensible wrench handle for use with a removable wrench head having a neck with a drive hole, comprising in combination:

a primary handle having a longitudinal axis which runs from a forward end to a rearward end, the primary handle having a generally rectangular main portion and an upward facing shoulder located on one side of the main portion;

a plurality of notches located in the upward facing shoulder;

a hollow extension having a longitudinal axis which runs along its length and having an interior which corresponds to the primary handle, the extension mounting over the primary handle so that the extension may be slid coaxially to various positions along the length of the primary handle, for increasing and decreasing leverage during torque;

an aperture in the extension adjacent the notches;

a pawl having a tongue with a forward end and a rearward end, the rearward end being mounted to the extension, the tongue being movable around an axis extending through the rearward end, allowing the pawl to be moved from an upper open position to a lower closed position, and having a locking member located on the forward end of the tongue that protrudes through the aperture in the extension for engaging the notches of the primary handle when the pawl is in the closed position, the pawl keeping the extension locked in place when the locking member is engaged with one of the notches; and wherein the primary handle has a cross beam shape, with the upward facing shoulder being located on a first generally rectangular side band, the primary handle having a second generally rectangular side band located on an opposite side of the main portion from the first side band.

9. A removable wrench handle for use with an open end wrench head, the wrench head having a neck with a drive hole, comprising in combination:

a primary handle having a longitudinal axis which extends from a forward end to a rearward end;

a flex head having a flat surface and a heel member protruding perpendicular from the flat surface, the heel member having a heel surface adapted to contact a side of the neck of the wrench head; and a drive post which protrudes from the flat surface of the flex head, the drive post being spaced apart from the heel member, defining a clearance for receiving the wrench head, the drive post being insertable into the drive hole in the neck of the wrench head; and means for pivotally mounting the flex head to the forward end of the primary handle for allowing rotation of the flex head about a transverse axis which is perpendicular to the longitudinal axis of the primary handle; and wherein the heel surface is a convex curved surface having a decreasing radius from a center of the heel member to the edges of the heel member.

10. A removable wrench handle for use with an open end wrench head, the wrench head having a neck with a drive hole, comprising in combination:

a primary handle having a longitudinal axis which extends from a forward end to a rearward end;

a flex head having a flat surface and a heel member protruding perpendicular from the flat surface, the heel member having a heel surface adapted to contact a side of the neck of the wrench head;

a drive post which protrudes from the flat surface of the flex head, the drive post being spaced apart from the heel member, defining a clearance for receiving the wrench head, the drive post being insertable into the drive hole in the neck of the wrench head; and means for pivotally mounting the flex head to the forward end of the primary handle for allowing rotation of the flex head about a transverse axis which is perpendicular to the longitudinal axis of the primary handle; and wherein the drive post has edges which are convex curved surfaces which decrease in radius from a center of each edge to an outer extent.

* * * * *